United States Patent [19]

Westergaard

[11] Patent Number: 4,703,590

[45] Date of Patent: Nov. 3, 1987

[54] METHOD AND APPARATUS FOR PARTICLE BLASTING USING PARTICLES OF A MATERIAL THAT CHANGES ITS STATE

[76] Inventor: Knud E. Westergaard, Rolighedsvej 16, 9560 Hadsund, Denmark

[21] Appl. No.: 800,021

[22] Filed: Nov. 20, 1985

[30] Foreign Application Priority Data

Nov. 20, 1984 [DK] Denmark ..... 5508/84

[51] Int. Cl.[4] ..... B24C 1/00

[52] U.S. Cl. ..... 51/320; 51/321; 51/410; 51/322; 51/436

[58] Field of Search ..... 51/319, 320, 321, 314–316, 51/410, 322, 436; 62/346; 222/146.6, 368

[56] References Cited

U.S. PATENT DOCUMENTS

| | | | |
|---|---|---|---|
| 2,403,406 | 7/1946 | Smith | 62/346 |
| 3,089,775 | 5/1963 | Lindall | 51/320 |
| 3,676,963 | 7/1972 | Rice et al. | 51/320 |
| 4,389,820 | 6/1983 | Fong | 51/320 |

FOREIGN PATENT DOCUMENTS

| | | | |
|---|---|---|---|
| 0070710 | 6/1942 | Czechoslovakia | 62/346 |
| 92884 | 3/1962 | Denmark . | |
| 1932376 | 1/1971 | Fed. Rep. of Germany . | |
| 891064 | 2/1944 | France . | |
| 0159414 | 7/1957 | Sweden | 62/346 |
| 413380 | 9/1974 | Sweden . | |

*Primary Examiner*—Frederick R. Schmidt
*Assistant Examiner*—Robert A. Rose
*Attorney, Agent, or Firm*—Felfe & Lynch

[57] ABSTRACT

Disclosed is an apparatus and method for use in particle blasting of particles that change state before the particle blasting, wherein the particles are cast or frozen in mould chambers to give the particles any desired shape. The apparatus for casting or freezing has a rotatable drum in the outer surface of which open mould chambers are formed, which chambers can be closed by the inner surface of a freezing cylinder, the freezing zone of which can be cooled by means of a cooling chamber provided with a cooling medium through supply and discharge tubes. The cast particles are released from the drum, the outer jacket of which may consist of an elastic material of rubber for facilitating the moulding, and then fall down into a discharge chamber, form which they are sucked into the particle-blasting pistol, through a particle discharge tube. In the pistol, the ice particles are mixed for instance with water at high pressure, which by an ejector effect creates the necessary low pressure for suction, and which ejects the ice particles against the surface to be treated.

6 Claims, 3 Drawing Figures

METHOD AND APPARATUS FOR PARTICLE BLASTING USING PARTICLES OF A MATERIAL THAT CHANGES ITS STATE

TECHNICAL FIELD

The present invention relates to a method for particle blasting of the kind which uses particles of a material that changes its state to the solid state before the blasting process.

An example of a material of this kind is water, as in this case the particles would consist of ice. In the following the invention is explained with reference to use of ice particles for particle blasting, but the invention is not restricted to this particular material, as it could be imagined that other liquids than water could be used as starting material, all dependent on the conditions—especially the temperature conditions—in the individual case.

BACKGROUND ART

Several methods are known for treating articles or materials by particle blasting using particles of a material that can change its physical state, for instance ice or solid carbon dioxide. See for instance DK Pat. No. 92.884, Swedish published specification with the publication No. 413.380, GB Pat. No. 1,397,102, GB Patent Application No. 2,095, 538 and U.S. Pat. No. 3,676,963.

The above-mentioned specifications contain only a brief mention of how it is contemplated that the ice particles in question could be produced. Processes referred to comprise either crushing followed by screening, peeling off or scraping, possibly with subsequent grinding, or condensation or freezing in a cooling fluid. It is obvious that by producing ice particles in the ways thus indicated, control of the final form of the particles will be quite poor. Granted, the SE published specification No. 413,380 mentions certain desired characteristics of the finished particles, but the specification does not state anything concrete as to how the particles are to be produced. Further, said publication refers to particles of sublimable substance, for instance solid carbon dioxide or "carbon dioxide snow", which can only be formed by compression of particles smaller than the desired finished particles.

DISCLOSURE OF THE INVENTION

On this background it is the object of the invention to provide a method of the kind mentioned in the introduction wherein a more comprehensive control of the shape of the particles used can be obtained, so that the shape of the particles may be adapted to the needs of the particular application.

The object stated is accomplished according to the invention by using particles that before blasting are formed by casting or freezing in mould chambers that are limited by walls of solid material. In this way, the shape of the particles can be determined to an extent restricted only by limitations that may be connected with the casting or freezing process in question.

A first embodiment of the method according to the invention is characteristic in that the particles are moved from the place where they have been formed to a particle blasting device by means of an air stream produced by injector effect in the particle blasting device from a liquid supplied at a high pressure. By this is achieved that the liquid which is used for impacting the surface to be treated with particles can be used to move the particles to the particle blasting device, which may be a "pistol" for instance, constructed like a sandblasting pistol.

In a second embodiment the method according to the invention is characteristic in that the above-mentioned liquid is the same or mainly of the same type as the one used for casting or freezing of the particles. As a result of this, after having moved the particles to the surface which is to be treated, the liquid together with the particles which at this stage are more or less melted can be brought back to the place where the particles are formed and be used as new starting material.

The invention also relates to an apparatus for use in carrying out the method of the invention. This apparatus is of the type that comprises a particle blasting pistol having an ejection nozzle for the particles, possibly together with a medium for carrying and transporting said particles, and according to the invention the apparatus is characterized by having a device for producing particles by casting or freezing in mould chambers of a liquid introduced through a supply tube, the casted or frozen particles being sucked out from a discharge chamber by the transport medium, for instance by ejector effect of a carrier medium supplied to the particle blasting pistol at a high pressure.

According to the invention, the mentioned device may consist of (a) a supply tube for a liquid starting material for forming particles, (b) a casting or freezing cylinder capable of being at least partly cooled and being connected to the discharge end of the supply tube, said cylinder having a mainly circular-cylindrical interior surface only interrupted by the said discharge end of the supply tube and the freezing cylinder's exit into the discharge chamber for finished particles, (c) a rotatable drum placed in the casting or freezing cylinder, said drum having open mould chambers formed at its outer surface, which chambers together with said interior surface of the freezing cylinder form closed casting or freezing chambers in the areas where the surface is uninterrupted, (d) the said discharge chamber which is placed at a distance from the said exit of the supply tube opposite an open part of the casting or freezing cylinder, and (e) a particle discharge pipe through which the finished particles can be removed from the discharge chamber.

According to the invention, a suitable embodiment of the apparatus is characteristic in that a jacket is placed on the outer surface of the drum, said jacket being made of a soft elastic material, such as rubber, in which the mould chambers are formed, and which is dimensioned in relation to the inner surface of the freezing cylinder such that the jacket is elastically compressed at least at the part situated opposite the part of the inner surface closest to the discharge chamber and on the "upstream side" of same. The result of this is that the mould chambers are deformed during their movement along the inner surface of the freezing cylinder, and that the deformation ceases at the entrance to the discharge chamber, thus casuing a bending effect on the part in question of the jacket of soft elastic material, whereby the casted or frozen particles are released from the mould chambers.

A further development of the apparatus according to the last-mentioned embodiment is characteristic in that the jacket consists of a radially outwards facing surface layer of a material impervious to liquid, in which the mould chambers are formed, and radially within said surface layer a softer layer of for instance foam rubber. In this way, a large bending effect of the mould chambers is achieved without requiring great force to compress the jacket of soft elastic material, as this could cause a strong braking of the jacket relative to the inner surface of the freezing cylinder.

BRIEF DESCRIPTION OF THE DRAWINGS

The invention is explained in more detail in the following with reference to the drawing, in which.

DESCRIPTION OF THE PREFERRED EMBODIMENT

Figure 1:
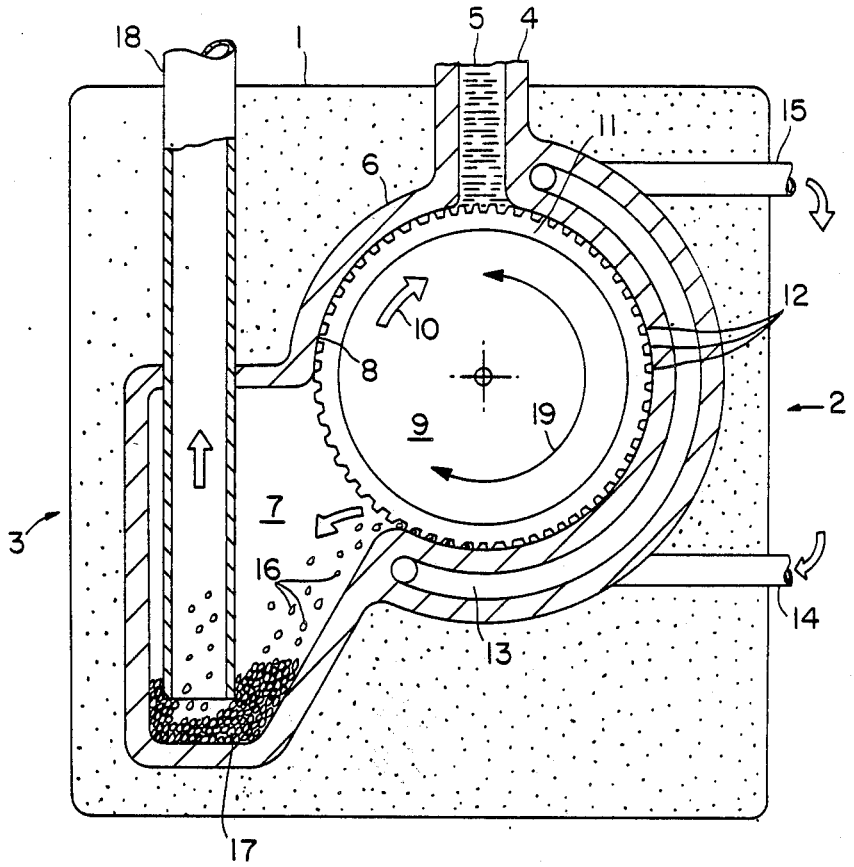
FIG. 1 shows an example of a device for producing ice particles.

The machine for producing ice particles shown in FIG. 1 is enveloped in a heat insulating jacket 1 and consists mainly of a freezing section 2 and a discharge section 3. The freezing section 2 includes a water supply tube 4 through which water 5 is supplied to the freezing section 2. The water supply tube 4 terminates downwardly in a freezing cylinder 6, which—apart from the place where the water supply tube 4 is introduced and a discharge chamber 7 is placed contiguous with the freezing cylinder—has a smooth circular-cylindrical inner surface 8. A drum 9 is rotatably mounted inside the freezing cylinder 6, which drum can be driven by means not shown in the direction shown by the arrow 10. Outside the drum 9, a freeze-mould jacket 11 of a soft elastic material, for instance rubber, is placed, the outside of which is arranged to be in fluid-tight sliding contact with the inner surface 8 of the freezing cylinder 6, and in which outside a large number of freeze-mould chambers 12 are formed. In the part of the freezing cylinder 6 passed by the freeze-mould jacket 11 during its movement from the water supply tube 4 to the discharge chamber 7, i.e. generally speaking the right half shown in FIG. 1, a cooling chamber 13 is formed and arranged to be supplied with a suitable cooling medium, such as for instance "FREON" ® or a strongly cooled saline solution, through a cooling medium supply tube 14, the cooling medium after its passage through the cooling chamber 13 leaving same through a cooling medium discharge tube 15. The arrangement is preferably such that the cooling medium is introduced in the cooling chamber 13 at the end which in the direction of rotation 10 is situated most distant from the water supply tube 4, and that the cooling medium leaves the chamber 13 through the opposite end, i.e. the end closest to the water supply tube 4. In this way, a "counterflow effect" is obtained, i.e. that the portions of water situated in the individual freeze-moulding chambers 12 move in the opposite direction of the cooling medium flowing through the cooling chamber 13. In a manner not shown, the freeze-moulding jacket 11 made of a soft elastic material may consist of two layers, namely an outer layer impervious to liquid, in which the freeze-moulding chambers are arranged, and an inner and more yielding layer, for instance made of foam rubber, and the inner surface 8 in the freezing cylinder 6 may be situated and formed in such a way in relation to the drum 9 that the freeze-moulding jacket 11 is compressed rather strongly, at least in that area where it approaches the discharge chamber 7 during rotation in the direction of rotation 1. In this way, it is achieved that the part of the freeze-moulding jacket 11, in which the freeze-moulding chambers 12 are formed, is bent strongly at the inlet to the discharge chamber 7, whereby the ice particles 16 formed are released from the freeze-moulding chambers 12 and fall down into the lower part 17 of the discharge chamber 7, and from there they are sucked out through a particle discharge tube 18 by means of an air stream.

In the embodiment shown, the freezing zone proper—i.e. the area where the cooling chamber 13 effectively cools and freezes the water supplied through the water supply tube 4—covers an angle 19 of approx. 200°. However, this angle may be reduced or increased, increased, for instance, by moving the water supply tube 4 counterclockwise to a location close to the discharge chamber 7.

Because of the manner in which the ice particles are shaped in the freeze-moulding chambers 12, namely between on the one side an indentation in the freeze-moulding jacket 11 and on the other side the smooth inner surface 8 in the freezing cylinder 6, the finished ice particles 16 will be provided with at least one circumferential sharp edge corresponding to the transition region between the freezemoulding chambers 12 and the inner surface 8. However, by suitably shaping the freeze-moulding chambers 12, it is possible to produce a greater number of sharp edges of corners on the ice particles 16, should this be desired with a view to a certain processing effect.

Figure 2:
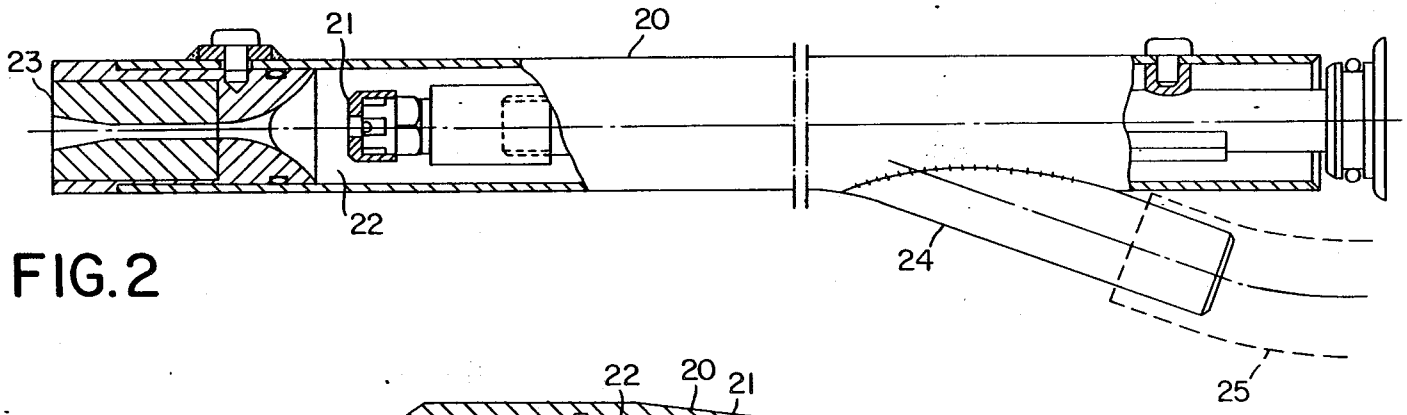
FIGS. 2 and 3 show examples of particle blasting pistols, which can be used when carrying out the method according to the invention.
Figure 3:
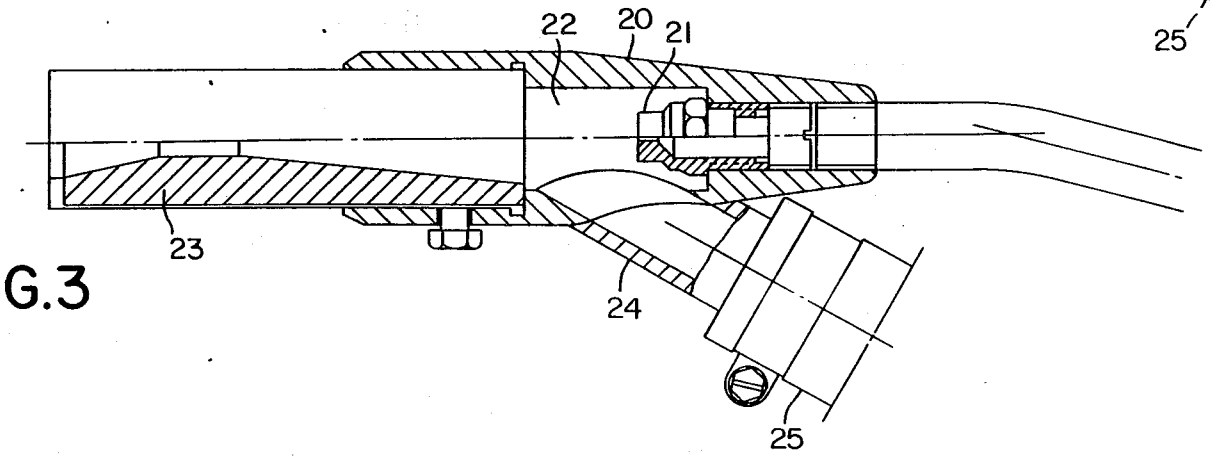

FIGS. 2 and 3 show examples of particle-blasting pistols, which may be used when carrying out the method according to the invention. Each particle-blasting pistol 20 has a water jet nozzle 21 which can be fed with water at high pressure, for instance between 100 to 200 bars. The water jet nozzle 21 is arranged to eject a water jet through a suction chamber 22 out into a convergent-divergent nozzle or venturi nozzle 23, which during operation is directed towards the surface to be treated. The injection effect resulting from the flow of the water jet through the venturi nozzle 23 creates a strong sub-atmospheric pressure in the suction chamber 22, which is connected to the particle discharge tube 18 throug a suction pipe stub 24 and a suction hose 25. In this way, the ice particles 16 are sucked into the pistol 20 and carried by means of the water jet, not shown, from the water jet nozzle 21 with great speed out through the venturi nozzle 23 and hit the surface being treated. When the ice particles have "done their work", they can be removed from the treatment zone in a manner known per se, together with the material loosened during the operation. Apart from the humidity possibly generated, the ice particles cause no pollution of the surroundings, such as may be the case, for instance, when using sand particles. If the temperatures is sufficiently high to melt the ice particles at this stage, they will also contribute to bind any dust that may have been produced during the treatment.

The invention has been explained above whilst referring to the use of particles of ice—i.e. congealed water—as processing particles in a particle blasting process. However, the principle of the invention can also be performed by using other liquids than water, for instance a low melting point alloy of a relatively great hardness, which is cast into processing particles in a machine of a similar construction to the one shown in FIG. 1, possibly with the difference that the freeze-moulding jacket 11 is made of a material capable of withstanding the high temperature, for instance silicone rubber. The principle of the invention can also be used at lower temperatures, in which case a liquid with a low melting point must be used together with a correspondingly adapted machine.

To prevent conglomeration of ice particles 16 in the lower part 17 of the discharge chamber 7, it may be appropriate in the lower part 17 to place suitable level sensing means, which through suitable electrical circuits can stop the drum 9 or lower its speed until the level falls again. For the same purpose, stirring devices may be placed in the lower part 17 in order to keep the ice particles 16 in continuous movement.

The terms and expressions which have been employed are used as terms of description and not of limitation, and ther is no intention in the use of such terms and expressions of excluding any equivalents of the features shown and described or portions thereof, it being recognized that various modifications are possible within the scope of the invention.

I claim:

1. A method for particle blasting comprising:

introducing a liquid into a mold chamber on a rotatable element;

rotating said element relative to a circumferential stationary wall forming a part of said mold chamber;

solidifying the liquid in the mold chamber during rotation to form a sized and shaped particle, there being a sliding contact between the particle and the stationary circumferential wall;

removing the solidified particle from the chamber in a discharge area free of the stationary circumferential wall;

and impacting the particle against a surface to be treated.

2. The method of claim 1 wherein the formed particle is transported from the discharge area to a particle-blasting device by means of an air stream entraining the particle.

3. The method of claim 2 wherein the air stream is generated by an injector effect in the particle-blasting device by a liquid supplied at a high pressure.

4. The method of claim 3 wherein, the liquid is substantially the same as that used for forming the particle by solidification.

5. The method according to claim 1 wherein the particle is an ice particle.

6. The method according to claim 4, wherein the particle is an ice particle.

* * * * *